US011473743B1

(12) United States Patent
Lin

(10) Patent No.: US 11,473,743 B1
(45) Date of Patent: Oct. 18, 2022

(54) WATER-PROOF ILLUMINATING DEVICE

(71) Applicant: QUASAR OPTOELECTRONICS, INC., Taichung (TW)

(72) Inventor: Jui-Ching Lin, Taichung (TW)

(73) Assignee: QUASAR OPTOELECTRONICS, INC., Taichung (TW)

( * ) Notice: Subject to any disclaimer, the term of this patent is extended or adjusted under 35 U.S.C. 154(b) by 0 days.

(21) Appl. No.: 17/551,308

(22) Filed: Dec. 15, 2021

(51) Int. Cl.

| | |
|---|---|
| ***F21S 8/04*** | (2006.01) |
| ***F21V 17/12*** | (2006.01) |
| ***F21V 29/70*** | (2015.01) |
| ***F21S 4/28*** | (2016.01) |
| *F21Y 115/10* | (2016.01) |

(52) U.S. Cl.
CPC . *F21S 8/04* (2013.01); *F21S 4/28* (2016.01); *F21V 17/12* (2013.01); *F21V 29/70* (2015.01); *F21Y 2115/10* (2016.08)

(58) Field of Classification Search
CPC ..... F21S 4/28; F21S 8/04; F21S 8/043; F21K 9/237; F21K 9/235; F21V 17/12
See application file for complete search history.

(56) References Cited

U.S. PATENT DOCUMENTS

2007/0008731 A1* 1/2007 Halliwell ..... F21V 17/007 362/408
2014/0355272 A1* 12/2014 Chou ..... F21S 8/04 29/592.1
2015/0003069 A1* 1/2015 Medendorp, Jr. ..... F21S 8/026 362/294

* cited by examiner

*Primary Examiner* — Karabi Guharay
(74) *Attorney, Agent, or Firm* — Karin L. Williams; Alan D. Kamrath; Mayer & Williams PC

(57) ABSTRACT

An illuminating device has an illuminating assembly and a holding base. The illuminating assembly has a connection element mounted on a top of the illuminating assembly and has a threaded stub formed on and protruding from a top of the connection element. The holding base is connected with the illuminating assembly and has a base body and a nut. The base body a central hole, two fixing holes, and two fasteners. The central hole is defined through the base body and through which the threaded stub of the connection element extends. The fixing holes are defined through the holding base. The fasteners are mounted respectively through the two fixing holes and are adapted to be securely attached to a ceiling or a wall. The nut is screwed with the threaded stub on the connection element.

6 Claims, 7 Drawing Sheets

WATER-PROOF ILLUMINATING DEVICE

BACKGROUND OF THE INVENTION

1. Field of the Invention

The present invention relates to an illuminating device, and more particularly to a water-proof illuminating having a simplified structure and a lowered cost and being easily arranged and adjustable in angle.

2. Description of Related Art

A conventional water-proof illuminating device substantially comprises an illuminating tube, a holding base and two fixing bases. The illuminating tube is mounted on the holding base, and the two fixing bases are mounted respectively on two ends of the holding base. The fixing bases are securely attached onto a ceiling or a wall with fasteners. The conventional water-proof illuminating is complicated in structure, and the arrangement angle of the illuminating base is not adjustable after the illuminating device is secured onto the ceiling or the wall.

To overcome the shortcomings, the present invention tends to provide an illuminating device to mitigate or obviate the aforementioned problems.

SUMMARY OF THE INVENTION

The main objective of the invention is to provide a water-proof illuminating device that is adjustable in an arrangement angle.

The illuminating device has an illuminating assembly and a holding base. The illuminating assembly has a top and a connection element. The connection element is mounted on the top of the illuminating assembly and has a threaded stub formed on and protruding from a top of the connection element. The holding base is connected with the illuminating assembly and has a base body and a nut. The base body a central hole, two fixing holes, and two fasteners. The central hole is defined through the base body and through which the threaded stub of the connection element extends. The fixing holes are defined through the holding base. The fasteners are mounted respectively through the two fixing holes and are adapted to be securely attached to a ceiling or a wall. The nut is screwed with the threaded stub on the connection element.

Other objects, advantages and novel features of the invention will become more apparent from the following detailed description when taken in conjunction with the accompanying drawings.

DETAILED DESCRIPTION OF PREFERRED EMBODIMENT

Figure 1:
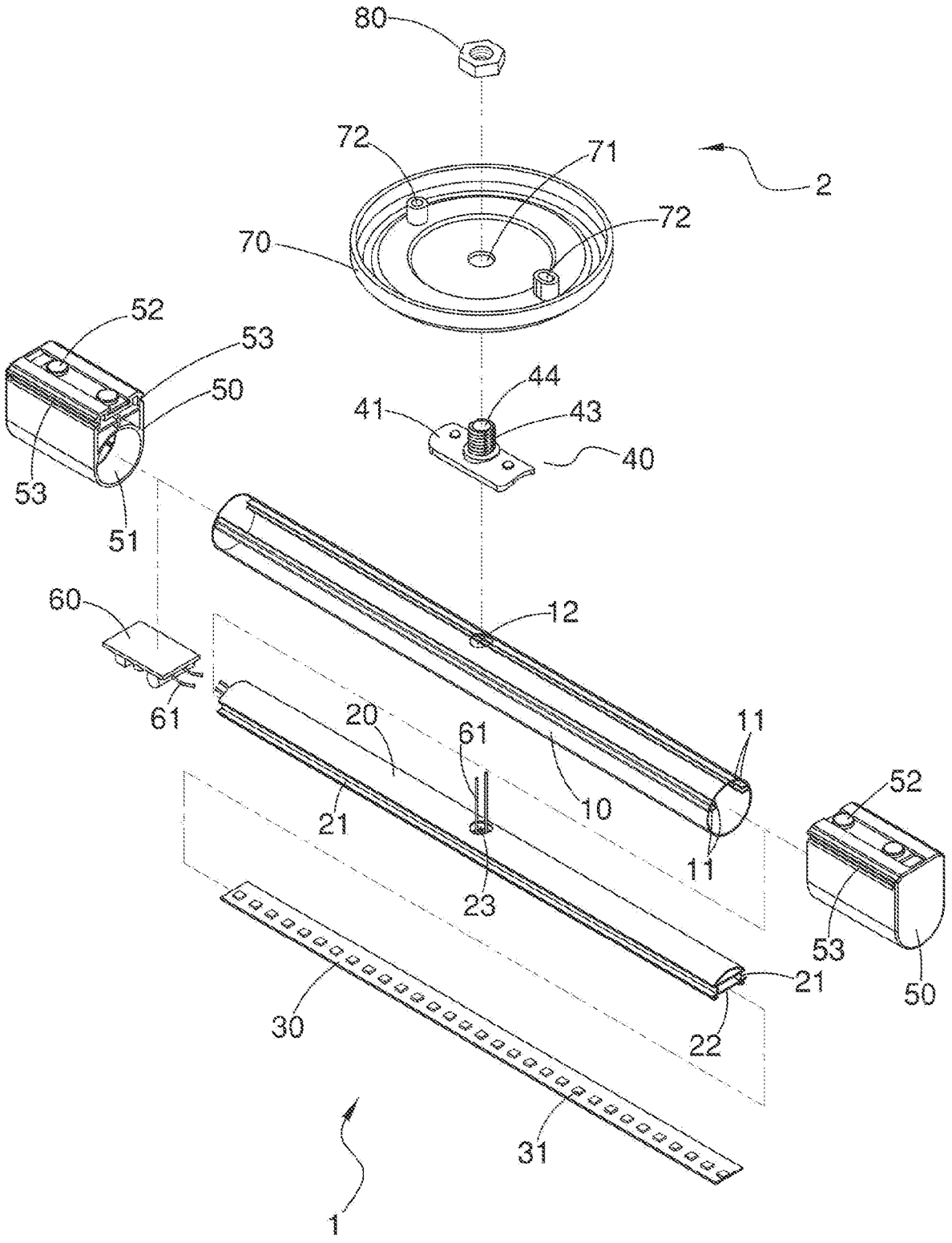
FIG. 1 is an exploded perspective view of a illuminating device in accordance with the present invention.

With reference to FIGS. 1 to 5, an illuminating device in accordance with the present invention comprises an illuminating assembly 1 and a holding base 2.

The illuminating assembly 1 comprises an illuminating tube 10, a heat-dissipating tube 20, an illuminating strip 30, a connection element 40, two side caps 50, two magnetic elements 52, and an actuator 60. The illuminating tube 10 is made of a light-transmission material, such as plastic, Acrylic or glass and has two opened ends. The illuminating tube 10 has two engaging ribs 11 formed longitudinally on an inner surface of the illuminating tube 10. An upper hole 12 is defined in the top of the illuminating tube 10. The heat-dissipating tube 20 is made of a heat-dissipating material, such as copper or aluminum, is mounted in the illuminating tube 10 and has a through hole defined axially through the heat-dissipating tube 20. Two engaging grooves 21 are formed longitudinally in an outer surface of the heat-dissipating tube 20 and are engaged respectively with the engaging ribs 11 of the illuminating tube 10. A holding recess 22 is defined longitudinally in a bottom of the heat-dissipating tube 20. A lower hole 23 is defined in a top of the heat-dissipating tube 20 and is aligned with the upper hole 12 in the illuminating tube 10. The illuminating strip 30 is mounted in the illuminating tube 10, is held in the holding recess 22 in the heat-dissipating tube 20 and has multiple LEDs 31 (light-emitting diode) attached on a bottom of the illuminating strip 30 and arranged at intervals. Accordingly, the lights emitted from the LEDs 31 can be emitted downwardly and outside from the illuminating tube 10. The connection element 40 comprises a connection tab 41, a stud 42 and a threaded stub 43. The connection tab 41 is attached to the top of the illuminating tube 10. The stud 42 is formed on and protrudes from a bottom of the connection tab 41. The threaded stub 43 is formed on and protrudes from a top of the connection tab 41 and extends through the upper hole 12 and the lower hole 23. A through hole 44 is defined through the threaded stub 43, the connection tab 41, and the stud 42. The two side caps 50 are attached respectively around the two opened ends of the illuminating tube 10. Each side cap 50 has an engaging recess 51 defined in the side cap 50 to hold a corresponding one of the two opened ends of the illuminating tube 10 inside. The side caps 50 can be securely combined with the illuminating tube 10 with glue. The two magnetic elements 52 are attached respectively on the tops of the side caps 50 and can be magnetically attracted with a metal surface. The actuator 60 is mounted in one of the side caps 50, is electrically connected with the illuminating strip 30, and has two electrical wires 61 extending through the lower hole 23 in the heat-dissipating tube 20, the upper hole 12 in the illuminating tube 10, and the through hole 44 in the connection element 40 and connected to an external power source.

The holding base 2 is connected with the illuminating assembly 1 and comprises a base body 70 and a nut 80. The base body 70 may have a circular, oval, rectangular, flower, or star shape. A central hole 71 is defined through a center of the base body 70, and the threaded stub 43 of the connection element 40 extends through the central hole 71. Two fixing holes 72 is defined through the holding base 70 and are diametrically opposite each other. Two fasteners 43 are mounted respectively through the two fixing holes 72 and are securely attached to a ceiling or a wall. In addition, at least one of the two fixing holes 72 in the holding base 70 is an elongated hole. The nut 80 is screwed with the threaded stub 43 on the connection element 40, such that the illuminating assembly 1 is connected securely with the holding base 2.

Figure 5:
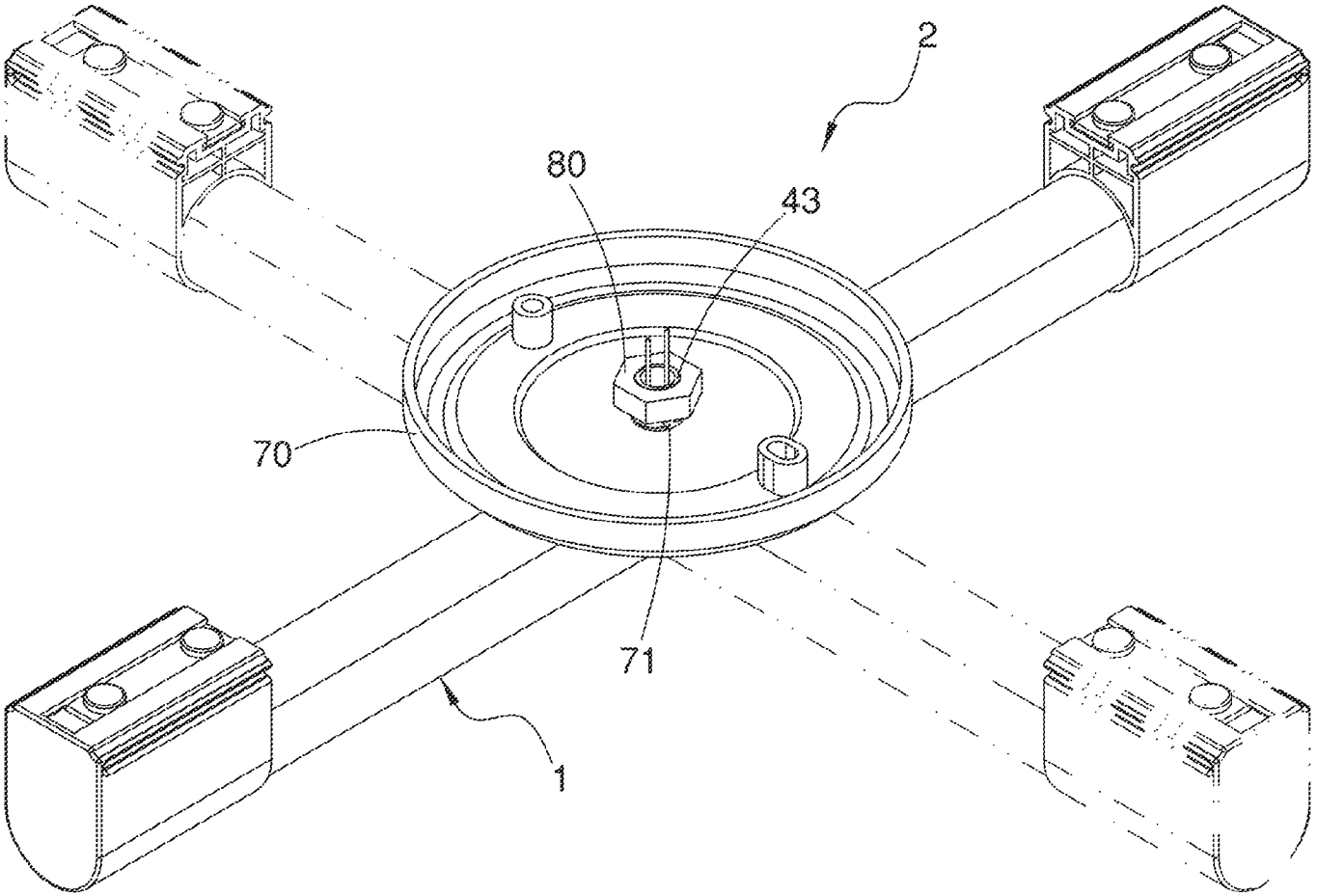
FIG. 5 is an operational perspective side view of illuminating device in FIG. 2.

With reference to FIG. 5, when the nut 80 is loosened from the threaded stub 43, the arrangement angle of the illuminating assembly 1 relative to the holding base 2 can be adjusted to fit with the user's demands.

Figure 2:
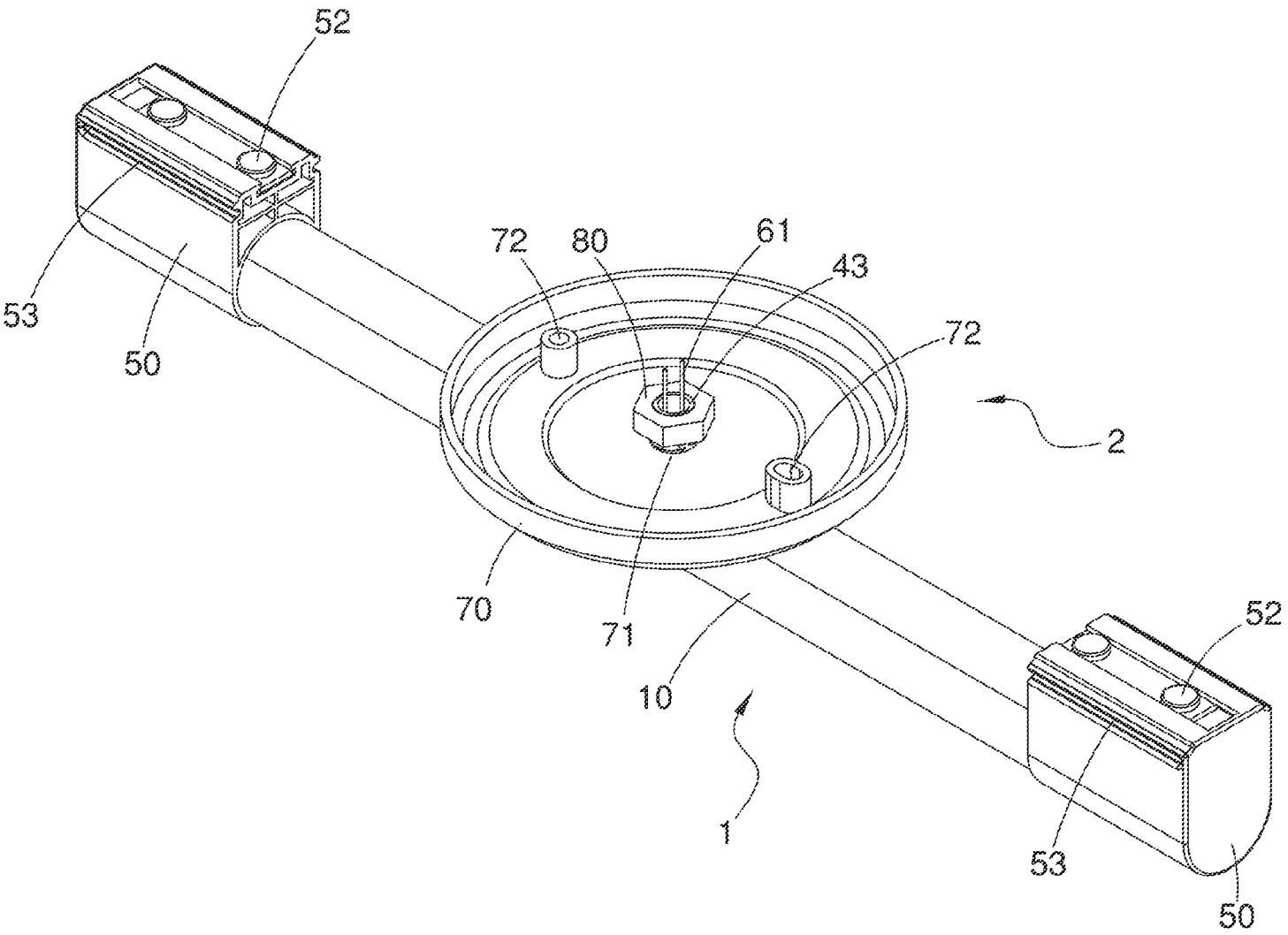
FIG. 2 is an enlarged perspective view of the illuminating device in FIG. 1.
Figure 3:
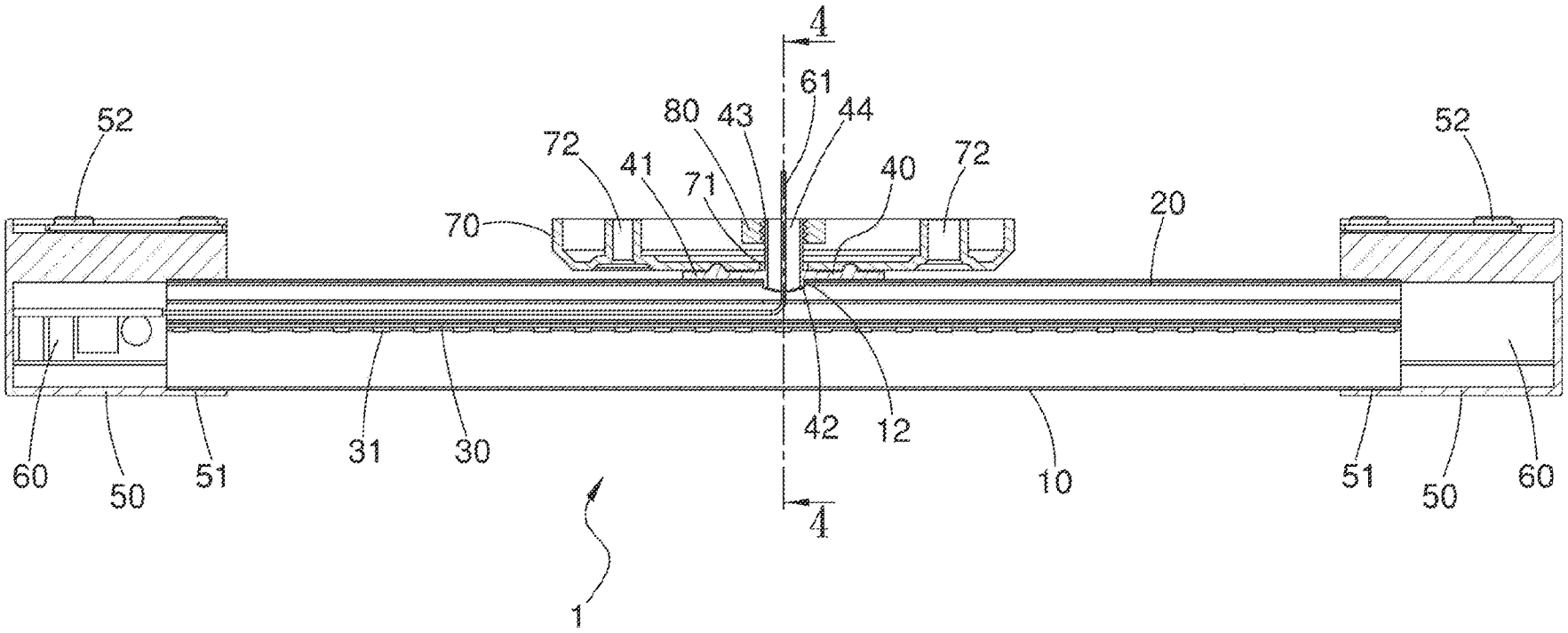
FIG. 3 is a side view in partial section of the illuminating device in FIG. 2.
Figure 4:
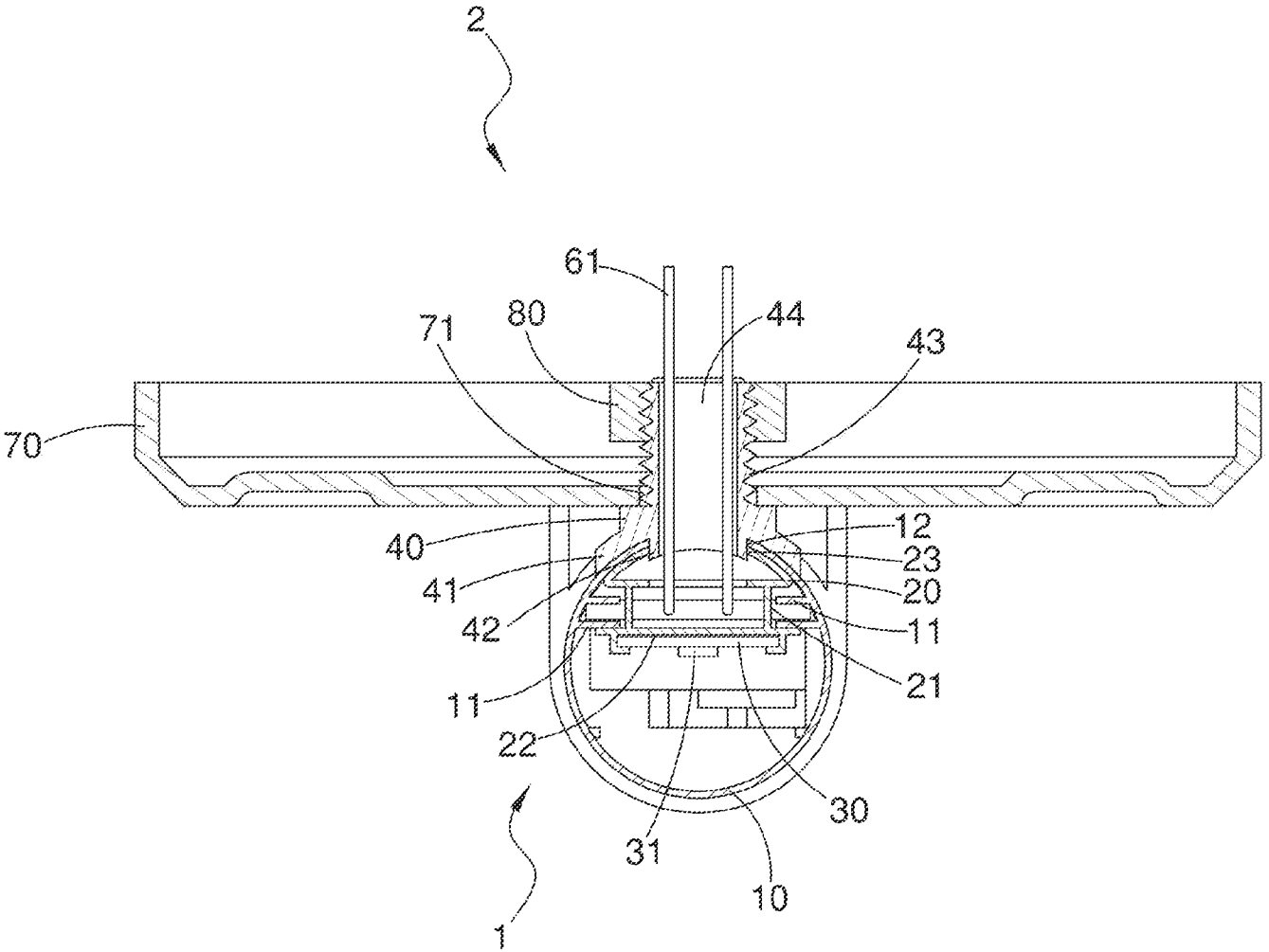
FIG. 4 is an end view of the illuminating device along the line 4-4 in FIG. 3.

With reference to FIGS. 2 and 3, the illuminating assembly 1 can be attached to a ceiling or a wall with the magnetic elements 52 without the holding base 2, such that the illuminating device in accordance with present invention can be arranged onto a metal surface conveniently.

Figure 6:
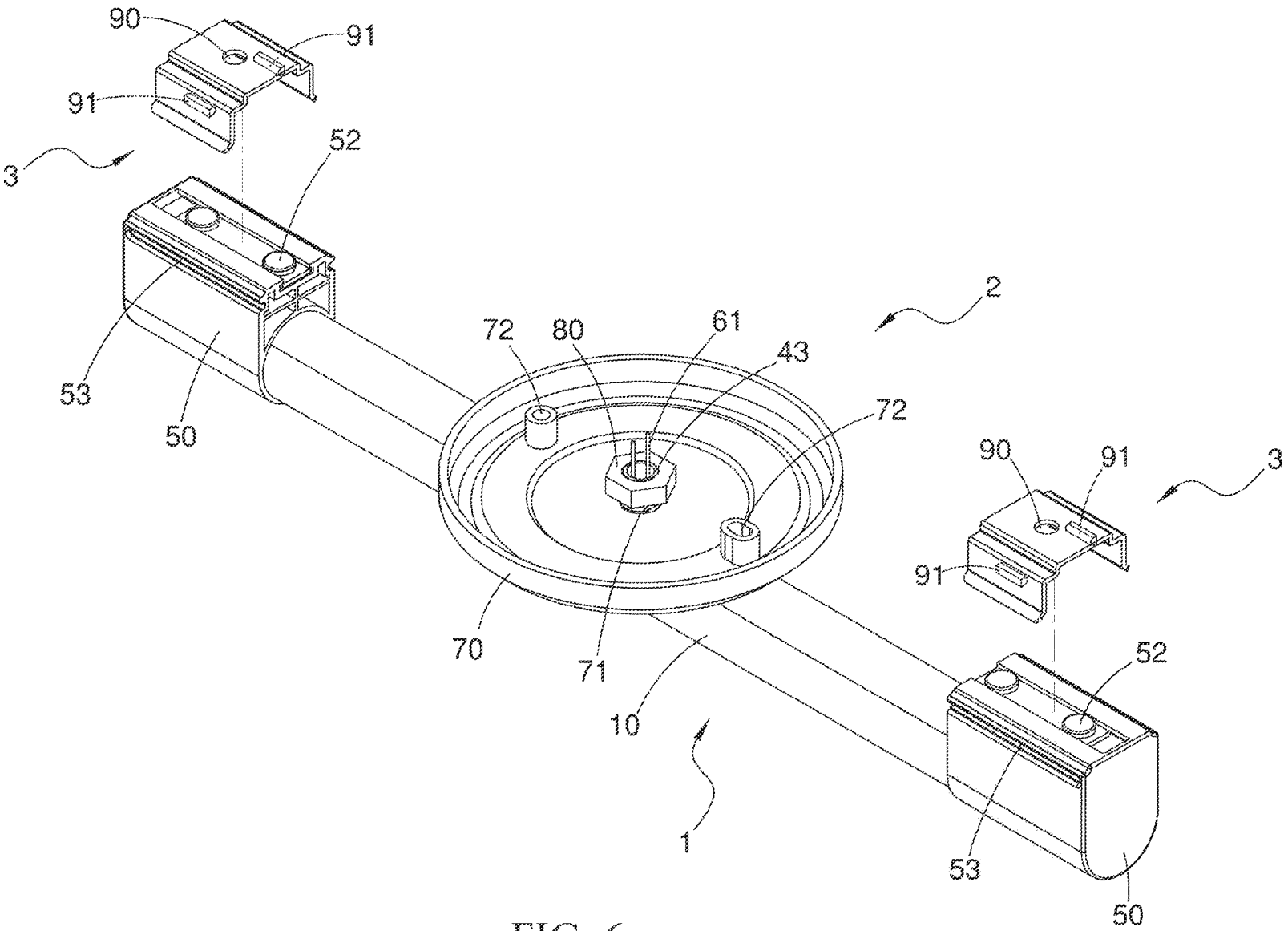
FIG. 6 is an exploded perspective view of another embodiment of an illuminating device in accordance with the present invention.
Figure 7:
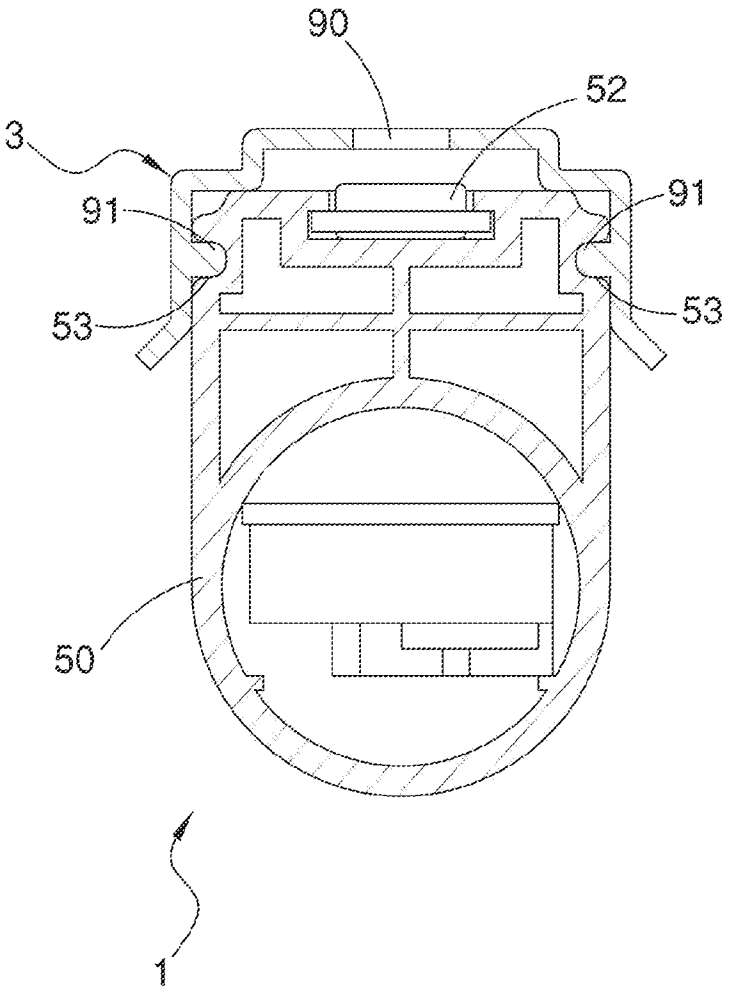
FIG. 7 is an end view in partial section of the illuminating device in FIG. 6.

With reference to FIGS. 6 and 7, in another embodiment, each side cap 50 has two holding recesses 53 defined respectively in two sides of the side cap 50. The illuminating device further comprises two holding members 3 attached respectively to the two side caps 50. Each holding member 3 comprises a top tab and two side tabs. The side tabs extending downwardly from two sides of the top tabs respectively. A holding hole 90 is defined through a top of the top tab. A fastener is mounted through the holing hole 90 and can be attached to a ceiling or a wall, such that the holding member 3 can be secured onto the ceiling or the wall. Two protrusions 91 are formed on the two side tabs and are resiliently engaged with two holding recesses 53 in the corresponding side cap 50 respectively. Accordingly, the illuminating device can be arranged onto a ceiling or a wall conveniently.

The illuminating device in accordance with the present invention has simplified structure and a lowered manufacturing cost. With the arrangement of the threaded stub 43 and the nut 80, the arrangement angle of the illuminating assembly 1 can be easily adjusted.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An illuminating device comprising:

an illuminating assembly having a top; and a connection element mounted on the top of the illuminating assembly and having a threaded stub formed on and protruding from a top of the connection element; and a holding base connected with the illuminating assembly and comprising a base body having a central hole defined through the base body and through which the threaded stub of the connection element extends;

two fixing holes defined through the holding base; and two fasteners mounted respectively through the two fixing holes and adapted to be securely attached to a ceiling or a wall; and a nut screwed with the threaded stub on the connection element;

wherein:

the illuminating assembly comprises an illuminating tube being made of a light-transmission material and having two opened ends;

a heat-dissipating tube mounted in the illuminating tube and having a through hole defined axially through the heat-dissipating tube;

an illuminating strip mounted in the illuminating tube, attached on a bottom of the heat-dissipating tube and having multiple LEDs (light-emitting diode) attached on a bottom of the illuminating strip and arranged at intervals; and two side caps attached respectively around the two opened ends of the illuminating tube, and each side cap having an engaging recess defined in the side cap to hold a corresponding one of the two opened ends of the illuminating tube inside;

the connection element comprises a connection tab attached to a top of the illuminating tube; and the threaded stub is formed on and protrudes from a top of the connection tab.

2. The illuminating device as claimed in claim 1, wherein the illuminating tube has two engaging ribs formed longitudinally on an inner surface of the illuminating tube; and the heat-dissipating tube has two engaging grooves formed longitudinally in an outer surface of the heat-dissipating tube and are engaged respectively with the engaging ribs of the illuminating tube; and a holding recess defined longitudinally in the bottom of the heat-dissipating tube to hold the illuminating strip inside.

3. The illuminating device as claimed in claim 1, wherein the illuminating assembly further comprises an actuator mounted in one of the side caps, electrically connected with the illuminating strip, and has two electrical wires;

the illuminating tube has an upper hole defined in a top of the illuminating tube;

the heat-dissipating tube has a lower hole defined m a top of the heat-dissipating tube;

the connection element has a through hole defined through the connection tab and the threaded stub; and the two electrical wires of the actuator extends through the lower hole in the heat-dissipating tube, the upper hole in the illuminating tube, and the through hole in the connection element and is adapted to be connected to an external power source.

4. The illuminating device as claimed in claim 1, wherein the illuminating assembly further comprises two agnetic elements attached respectively on the side caps.

5. The illuminating device as claimed in claim 1, wherein at least one of the two fixing holes in the holding base is an elongated hole.

6. The illuminating device as claimed in claim 1, further comprising two holding members attached respectively to the two side caps and each having a top tab;

two side tabs extending downwardly from two sides of the top tabs respectively;

a holding hole defined through a top of the top tab; and two protrusions formed on the two side tabs and resiliently engaged with two holding recesses defined respectively in two sides of a corresponding one of the side caps.

* * * * *